United States Patent [19]

Griffing et al.

[11] Patent Number: 4,653,380

[45] Date of Patent: Mar. 31, 1987

[54] BIPROPELLANT GUN AND METHOD OF FIRING SAME

[75] Inventors: Robert S. Griffing, Andover; David W. Sullivan, Brooklyn Park, both of Minn.

[73] Assignee: FMC Corporation, Chicago, Ill.

[21] Appl. No.: 621,006

[22] Filed: Jun. 15, 1984

[51] Int. Cl.[4] ..... F41F 1/04

[52] U.S. Cl. ..... 89/7; 102/440; 149/1

[58] Field of Search ..... 89/7; 102/440; 149/1

[56] References Cited

U.S. PATENT DOCUMENTS

| | | | |
|---|---|---|---|
| 3,004,841 | 10/1961 | Toulmin | 149/1 |
| 3,108,432 | 10/1963 | Balaceanu et al. | 149/1 |
| 3,147,091 | 9/1964 | Toulmin | 149/1 X |
| 3,763,739 | 10/1973 | Tassie | 89/7 |
| 4,333,383 | 6/1982 | Stansbury et al. | 89/7 |
| 4,357,856 | 11/1982 | Wood et al. | 89/7 |
| 4,393,781 | 7/1983 | Graf | 89/7 X |
| 4,478,128 | 10/1984 | Black et al. | 89/7 |
| 4,532,851 | 8/1985 | Reinelt et al. | 89/7 |

*Primary Examiner*—David H. Brown

*Attorney, Agent, or Firm*—Ronald C. Kamp; Richard B. Megley

[57] ABSTRACT

A bipropellant gun in which an immiscible hydrocarbon fuel and oxidizer are combined in the gun's combustion chamber just prior to, or simultaneous with, ignition thereof. The oxidizer consists of hydrogen peroxide having a concentration of less than 73 percent by weight. In one embodiment, the oxidizer alone is bulk loaded into the combustion chamber and a powdered solid hydrocarbon fuel is dispersed into the oxidizer by the function of a pyrotechnic igniter. In another embodiment, the oxidizer and a liquid hydrocarbon are emulsified and the emulsion is bulk loaded into the combustion chamber with a pyrotechnic igniter subsequently initiating combustion. In each embodiment, the volume of the combustion chamber exceeds the volume of fuel and oxidizer and provides a void or headspace of compressible gas which limits the rate of pressure rise in the chamber.

7 Claims, 2 Drawing Figures

BIPROPELLANT GUN AND METHOD OF FIRING SAME

Figure 1:
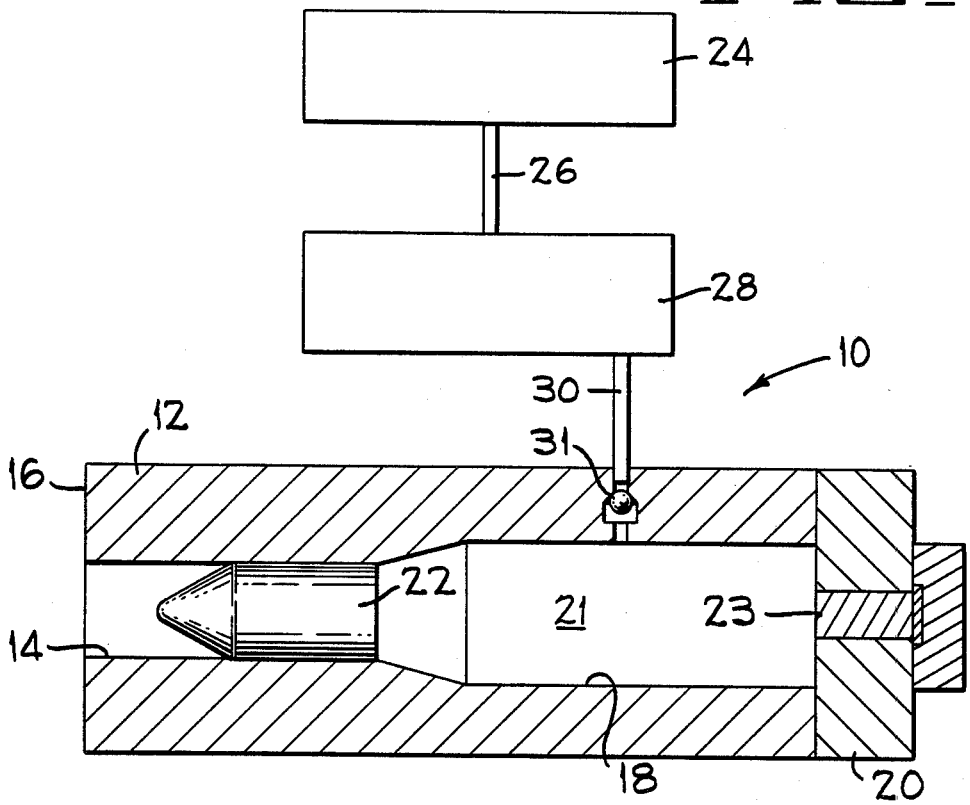

This invention relates to bipropellant guns and the methods of firing the same, and more particularly, to such guns and methods which utilize liquid oxidizers.

Prior art guns using a liquid monopropellant that fill the entire combustion chamber volume with propellant are inherently unsafe due to instabilities that are difficult to control. These problems are related to inclusion of small air bubbles in the combustion chamber during the load cycle. Compression of these bubbles suspended in the monopropellant may cause uncontrollable ignition due to adiabatic heating that results in hot ignition spots throughout the propellant volume. Zero ullage during the ignition phase may lead to excess pressure due to the higher bulk modulus of liquids. The present invention avoids these problems.

Prior art guns using a liquid propellant have utilized a regeneration process in which the fuel and oxidizer are pumped into the combustion chamber by a piston. The piston moves under the force of the combustion pressure and the rate of pressure increase is controlled by the rate at which the propellant is metered through the piston itself. There are several problems with such an arrangement including dieseling or auto-ignition of the propellant on the side of the piston opposite the combustion chamber due to pressure increase as a result of piston movement; flash-back, i.e., movement of the flame front through the metering orifices in the piston and/or premature ignition as a result of hot spots on the cylinder or adjacent wall or as a result of catalytic action caused by contaminants within the breech. The present invention avoids all of these problems.

The present invention provides a bipropellant gun which is relatively safe to fire, is reliable in that it produces a high degree of repeatability without failure, is relatively simple and economical in both its construction and operation, produces a high muzzle velocity and minimizes the logistic and material handling problems normally associated with gun propellants. These attributes are achieved by utilizing a liquid oxidizer of hydrogen peroxide having a concentration of less than 73% by weight which is bulk loaded directly into the combustion chamber. The fuel, which is immiscible with, or insoluble in, the oxidizer, may be either a liquid hydrocarbon, such as kerosene, which is dispersed in the oxidizer as small droplets as the oxidizer is bulk loaded, or a powdered solid hydrocarbon, such as coal, which is injected into and dispersed within the oxidizer by conventional pyrotechnic igniter means. Both fuels are safe, non-toxic, and easy to handle. The oxidizer has the same attributes in comparison to other liquid oxidizers, such as nitric acid. These fuels and oxidizers burn to release sufficient energy to propel a projectile at high velocity. The rate of combustion of the fuel and oxidizer is controllable because the fuel and oxidizer are immiscible and the burning rate is determined by the fineness of the powder or grain size of the solid fuel and the size of the droplet of the liquid fuel. The smaller the grain or droplet size the faster the rate of combustion. The volume of the combustion chamber in which the fuel and oxidizer react exceeds the volume of the oxidizer and fuel combined by typically 5 to 50 percent. The excess volume or head space in the combustion chamber is occupied by air and vaporized liquid, which compresses as the pressure increases as a result of the combustion. The compressible mass serves to limit the rate of pressure rise in the combustion chamber and contributes to the safe operation of the gun. Pyrotechnic ignition is preferred because such devices have been developed to an advanced stage and can be both predictable and reliable.

Figure 2:
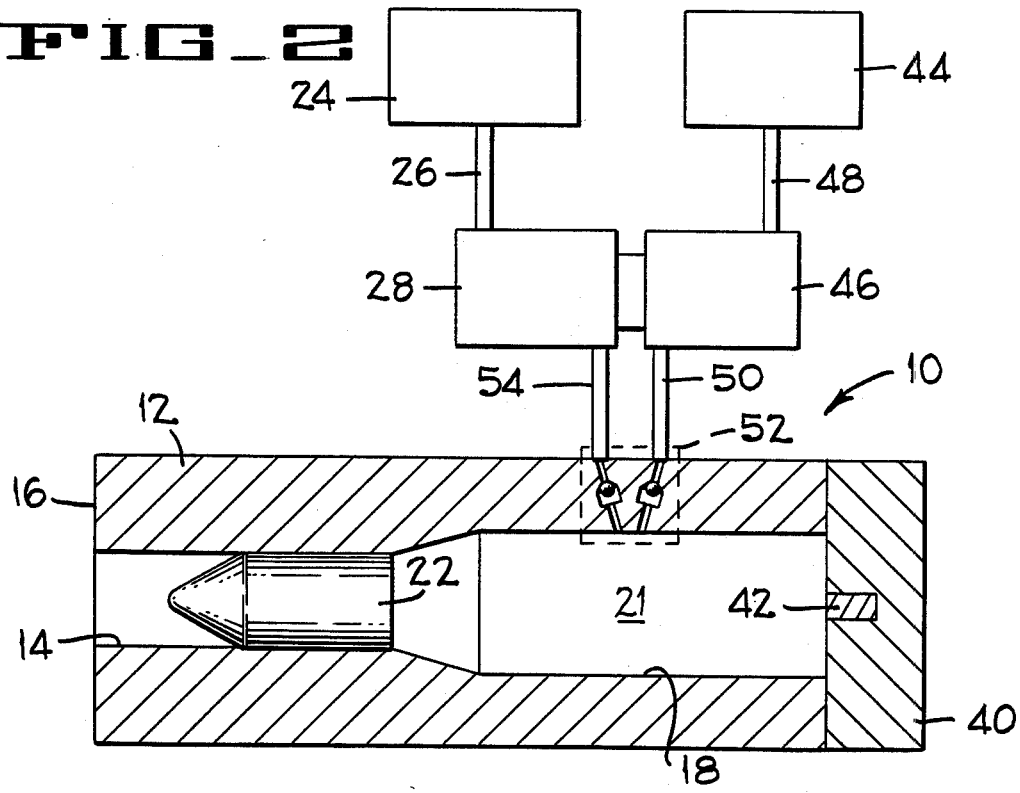

Other attributes and advantages of the present invention will become more readily apparent from a perusal of the following description and the accompanying drawing, wherein:

FIG. 1 is a schematic representation of a gun incorporating the present invention and utilizing a powdered solid fuel; and FIG. 2 is a schematic representation of a gun incorporating the present invention and utilizing a liquid fuel.

Referring to FIG. 1, a gun, indicated schematically at 10, has a barrel 12, with a central bore 14 extending from the muzzle end 16 to, and communicating with, a breech 18. A breech block 20 is attached to the breech end of the barrel and seals off the barrel when closed and permits loading of a projectile 22 when open. The breech block is provided with a recess which opens into the breech, and is designed to receive a canister 23, which contains a solid powdered hydrocarbon fuel, such as coal and a chemical pyrotechnic igniter. The actual arrangement of the fuel and igniter may vary. The fuel may be interspersed with the igniter material or the fuel arranged in a separate compartment of the canister inboard of the ingniter. The critical requirement is that the fuel be blown into the breech 18 as a result of the igniter being energized.

The oxidizer, which consists of hydrogen peroxide having a concentration of less than 73% by weight, is contained within a reservoir 24 and is connected by conduit 26 with the intake of a metering pump 28. A second conduit 30 connects the pump 28 with the breech 18. The oxidizer is pumped into the breech 18, which functions as a combustion chamber 21 since it is closed at one end by the projectile 22 and at the other end by the closed breech block 20. A check valve 31 permits the flow of liquid oxidizer into the breech but seals the breech against the pressure of combustion. The oxidizer at the concentration levels mentioned above is safe to handle, requiring no special precautions, and releases sufficient energy to provide high muzzle velocity to the projectile when reacted with the fuel. In order to prevent auto-ignition and to limit the rate of pressure rise within the combustion chamber, it is important that a void or head space be provided. The volume of the combustion chamber should be typically between 5 and 50% greater than the volume of the liquid pumped into the chamber. The gas which occupies this head space precludes pressure levels in the combustion chamber that would cause auto-ignition and serves to limit the rate of pressure rise within the combustion chamber.

The combustion rate is determined by the reacting area of contact between the fuel and oxidizer; the greater this reacting area the faster the combustion rate. The fineness of the powder fuel, i.e., its grain size, and the completeness of ignition determine this area, with the area increasing as the grain size decreases. The tolerable combustion rate is usually limited by the strength of the gun barrel. Once that is determined, the fineness of the powdered solid fuel is also determined.

The embodiment of FIG. 2 is similar to that shown in FIG. 1 and similar parts are given the same identifying numbers. The major difference is that a liquid fuel is utilized in FIG. 2. The breech block 40, which is somewhat similar to breech block 20 in FIG. 1, requires a recess to receive only a conventional pyrotechnic igniter 42. The liquid fuel is contained within a reservoir 44 which is connected to the intake of a metering pump 46 by conduit 48. The output of pump 46 is connected to conduit 50 with an emulsifier valve 52. The pump 28 and 46 are commonly driven but with displacements that determine a flow rate difference which is equal to the desired mix ratio between oxidizer and fuel. That is, the output of pump 28 will be about eight times that of pump 46 if stoichiometric oxidizer to fuel ratio is desired. The emulsifier valve 52 disperses the insoluble fuel, which preferably is a petroleum distillate having approximately 10 carbon atoms, such as kerosene, in the hydrogen peroxide, in the form of small droplets. The insolubility of the fuel and oxidizer is important to keep the fuel in droplet form. The size of the droplets and the completeness of ignition determines the rate of combustion, with that rate increased as the droplet size decreases.

While two embodiments of the present invention have been shown and described herein, it is to be understood that various changes and modifications may be made without departing from the spirit of the invention as defined by the scope of the appended claims.

What is claimed is:

1. In a gun having a barrel and a breech including a breech block which define, with a projectile positioned in the breech end of the barrel, a combustion chamber, the improvement comprising:

a source of liquid oxidizer consisting of hydrogen peroxide having a concentration of less than 73% by weight;

pump means for introducing said liquid oxidizer into said chamber;

a separate source of hydrocarbon fuel which is insoluble with said oxidizer;

means for introducing said hydrocarbon fuel into said chamber;

the combined volume of said oxidizer and fuel prior to reaction being less than the volume of said chamber; and means for igniting said fuel and oxidizer.

2. A bipropellant gun having a combustion chamber defined by a barrel and its associated breech, a projectile loaded therein and a breech block, comprising:

a source of liquid oxidizer;

pump and meter means for introducing a measured quantity of liquid oxidizer directly into said chamber;

a replaceable canister carried by said breech block and having a surface abutting said chamber; and a powdered solid fuel and a pyrotechnic igniter in said canister, whereby energizing said pyrotechnic igniter expells said fuel through said surface to disperse the same in said oxidizer and initiates combustion thereof.

3. A method of firing a projectile from a gun having a breech block comprising the steps of:

loading a projectile into said gun;

inserting a charge of powdered solid fuel in said breech chamber;

pumping a predetermined quantity of liquid oxidizer said fuel is insoluble into said combustion chamber; and simultaneously dispersing said fuel into said oxidizer and igniting said fuel and oxidizer.

4. A method of firing a projectile at a desired velocity from the barrel of a gun having a barrel and a breech block, comprising the steps of:

loading a selected projectile into said barrel;

inserting a pyrotechnic igniter in said breech block;

closing said breech block to form a combustion chamber;

determining the combustion rate necessary to achieve said velocity for said projectile;

forming within said gun droplets of an insoluble liquid fuel in an oxidizer of hydrogen peroxide with said droplets being sized to produce said combustion rate; and energizing said igniter.

5. A method of firing a projectile from a gun having a breech block and a barrel comprising the steps of:

loading said projectile into said barrel;

inserting a pyrotechnic igniter in said breech block;

closing said breech block to form a combustion chamber;

simultaneously forming an emulsion of an immiscible liquid fuel and hydrogen peroxide and injecting said emulsion into said chamber; and energizing said igniter.

6. A bipropellant gun having a combustion chamber defined by a projectile loaded therein, a breech and breech block, comprising:

separate sources of liquid oxidizer and immiscible liquid fuel;

first and second pump and meter means for separately introducing a measured quantity of liquid oxidizer and liquid fuel at a predetermined ratio into said chamber;

the volume of said chamber being a least 5% greater the volume of said quantity;

an emulsifier valve interposed between said pump means and said breech to determine the size of fuel droplets; and igniter means carried by said breech block for igniting said fuel and oxidizer, whereby the difference in said volumes limits the rate of pressure rise in said chamber resulting from combustion of said fuel and oxidizer.

7. the invention according to claim 6, wherein said igniter means is a pyrotechnic device.

* * * * *